United States Patent [19]

Osterhof

[11] 4,271,758

[45] Jun. 9, 1981

[54] SELECTIVE LOCKING DISPLAY WHEELS IN DIGIT PRINTERS

[75] Inventor: Klaus Osterhof, Berlin, Fed. Rep. of Germany

[73] Assignee: Maschinenbau "WAM" M. Osterhof KG, Berlin, Fed. Rep. of Germany

[21] Appl. No.: 952,398

[22] Filed: Oct. 18, 1978

[30] Foreign Application Priority Data

Oct. 20, 1977 [DE] Fed. Rep. of Germany ..... 2747559

[51] Int. Cl.[3] ..... B41J 1/60

[52] U.S. Cl. ..... 101/110; 74/371; 192/95; 192/48.8; 101/91

[58] Field of Search ..... 101/109, 110, 111, 76, 101/77, 85, 86; 74/371, 372, 373, 374, 375; 192/95, 48.91, 48.8

[56] References Cited

U.S. PATENT DOCUMENTS

| | | | |
|---|---|---|---|
| 1,341,021 | 5/1920 | Robbins | 101/110 |
| 1,868,997 | 7/1932 | Speicher | 101/110 |
| 3,024,724 | 3/1962 | Angus | 101/110 X |
| 3,427,961 | 2/1969 | Eggeringhaus | 101/110 X |
| 3,965,815 | 6/1976 | Lupkas et al. | 101/110 X |

FOREIGN PATENT DOCUMENTS

| | | | |
|---|---|---|---|
| 1121079 | 1/1962 | Fed. Rep. of Germany | 101/110 |
| 1259909 | 2/1968 | Fed. Rep. of Germany | 101/110 |

*Primary Examiner*—Edward M. Coven

*Attorney, Agent, or Firm*—Smyth, Pavitt, Siegemund & Martella

[57] ABSTRACT

A printer has a set of display wheels and print wheels on a common shaft for individual coupling to that shaft so that one display wheel and one print wheel at a time is rotationally adjusted, the selection of the wheel pair depends upon the axial disposition of the shaft. Particular structure is provided to hold wheels not to be turned in that fashion.

4 Claims, 3 Drawing Figures

II
II
4
6a
20
10
10'
18
19
13

III
III
4
4
6a
8
17
14
12a
13
15
12'
12
8'
16
10
10'
19
18

SELECTIVE LOCKING DISPLAY WHEELS IN DIGIT PRINTERS

BACKGROUND OF THE INVENTION

The present invention relates to a device for adjusting digits in printers, particularly label printers.

Label printers are, for example, constructed in that a set of print wheels and a set of display wheels are coaxially positioned on a shaft. This shaft is axially movable through these wheels and two separate adjusting rings on the shaft can be coupled, respectively, to one display wheel and one print wheel so that upon turning of the shaft a particular digit on the one wheel indicates the digit that will be printed in that particular position. Upon axially shifting the shaft, the adjusting rings are coupled to the display wheels and the print wheels in sequence to adjust the entire set. A pair of sleeves on that shaft, respectively, hold wheels which are not to be turned; these sleeves are locked against rotation but the shaft can move them axially. However, due to the axial displacement of the sleeves on and with the shaft, one display wheel after another is not held any more without further measure.

The German Pat. No. 1,121,079 discloses a label printer of that type generally, and provides spring biased locks, being balls urged into recesses of the display wheels, to prevent them from turning when not coupled to an adjusting element. It was found, however, that such a position lock does not suffice. For example, excess ink or the like mixed with dirt may lodge in the gap between the (intended) independent wheels and couple them together.

German Pat. No. 1,259,909 and U.S. Pat. No. 3,427,961 suggest the provision of a further, third, sleeve which holds display wheels analogous to the holding as provided by the above-mentioned other two sleeves. The problem here is that that third sleeve structurally extends the device which is undesirable.

DESCRIPTION OF THE INVENTION

It is an object of the present invention to provide for a new and improved digit printer with display and indicating wheels in which the latter wheels are held securely against unwanted rotation and consistently during different phases of operation.

It is a specific object of the present invention to improve a digit printer in which individual ones of a set of print wheels and individual ones of a set of display wheels are provided for connection, one wheel per set, to a shaft by means of two, axially displaced adjusting and connection means, whereby the pairing is changed by axial displacement of the shaft, the wheels between the two wheel adjusting and connection means and the print wheels on the other side of one of the adjusting or connection means are held against rotation by means of sleeves which move axially with the shaft but are held against rotation.

In accordance with the preferred embodiment of the present invention, it is suggested to improve a printer, generally of the type in accordance with or analogous to the specific object, by providing a locking member at and over the end of the shaft near the other one of the adjusting and connection means which locking member moves axially with the shaft but is held against rotation by a bar keyed to the locking member and held otherwise in a stationary position. Moreover, the shaft is hollow at least to some extent to telescopically receive the bar. The member has an axial width at least equal to the width of one display wheel but considerably less than the width of all the display wheels. The member is provided to engage at least where being next to the one engaged by the first adjusting and connection means, so that upon turning the shaft at least the display wheel next to the one being turned is positively held and will not rotate. The one next to the latter and those further away, do not have to be held as they will not be inadvertently coupled to the wheel that is being turned. It is important that this locking device will not or only very insignificantly extent the length of the unit as a whole.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows a printing cylinder 1, carrying a case or housing 2 for display wheels 4, as well as for print wheels 5. These wheels are eccentrically mounted to the print cylinder, but coaxial to each other.

Figure 1:
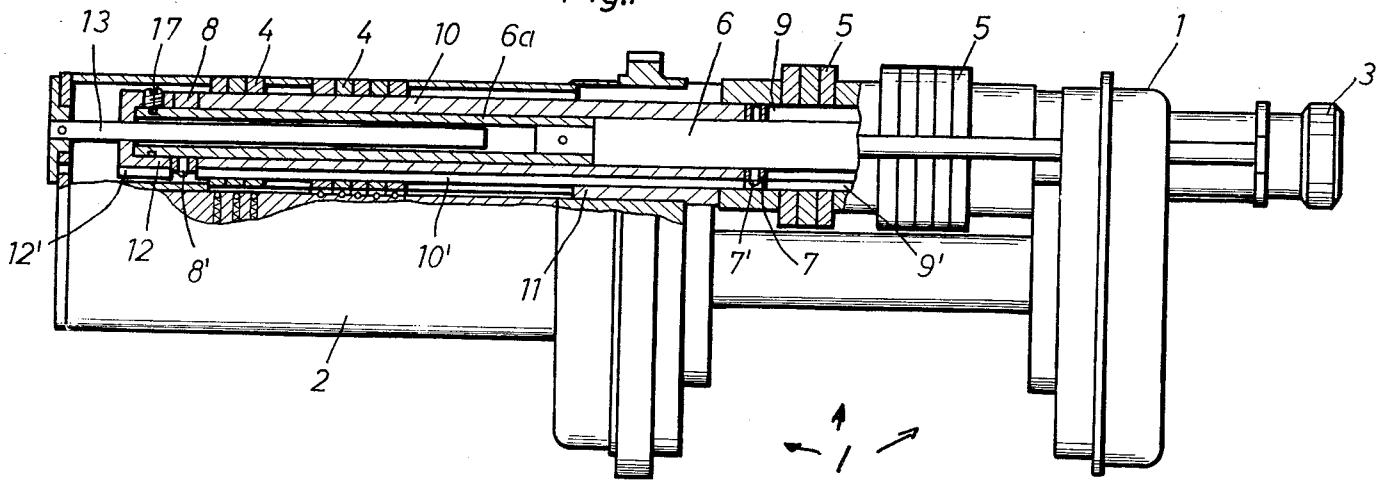
FIG. 1 is a side elevation, partially in section of a printing drum including printer proper and display.

The case 2 is longitudinally traversed by a shaft 6 which is axially displaceable. This shaft 6 is provided for coupling individual ones of the print wheels 5 with a knurled hand wheel 3, and with respectively individual ones of the display wheels. The coupling and connection proper is provided by means of axially spaced adjusting rings 7 and 8, which are secured to the shaft 6 and serve as connection and adjusting means.

The connection and coupling of the rings 7, 8 to the shaft 6 is respectively shown in greater detail for ring 8 as it is locked to the shaft by a pin 8'. The connection of ring 7 to shaft 6 is an analogous one using a pin 7'.

Upon axial displacement of the shaft 6 by means of axial displacement of knob 3, one can radially align ring 7 with a print wheel 5, while concurrently ring 8 is radially aligned with a wheel 4. The pins 7' and 8' project additionally radially outwardly in each instance and their rounded heads can be inserted into recesses 20, such as shown for a display wheel 4 in FIG. 3. The coupling of adjusting ring 7 to any print wheel 5 is an analogous one. Upon turning shaft 6 by means of knob 3, the respective print wheel 5 is adjusted as displayed by the correspondingly coupled display wheel 4. Upon axially displacing the shaft 6, the pair of wheels 4, 5 operatively coupled to the shaft and to each other, varies.

The respective wheels not to be turned in each of the adjusting steps are held in position in the following manner. A first sleeve 9 is seated on the shafts 6, moving therewith axially but being prevented from rotating as will be described shortly. This sleeve 9 is particularly disposed between the ring 7 and the knob 3. A second sleeve 10 is disposed in like manner between the two rings 7 and 8. The sleeve 10, for example, has a projection such as an inserted bar or ridge element 10' which projects beyond the periphery of the sleeve 10 (see particulary FIG. 3). The sleeve 9 has a similar bar, ridge or projection 9'. All these projections are provided for cooperation with recesses, whereby particularly the bar or ridge 10' cooperates with recesses 20 along the inner periphery of the several display wheels 4. As stated, the print wheels 5 have analogous recesses for cooperation with the bar, ridge or projection 9. Moreover, the right hand portion of ridge 10' is also operative in being inserted in recesses of the print wheels to the left of adjusting ring 7, if the shaft 6 is shifted to the right from the position illustrated in FIG. 1.

The bar or ridge 10', additionally, is inserted and reaches into a recess in a bearing bushing 11 of cylinder 1. There is a similar bearing bushing which engages the bar or ridge 9'. This way, the sleeves 9 and 10 are prevented to rotate about their axes. Thus, as the sleeves 9, 10 are held against rotation, their ridges 9', 10' hold all those of the wheels 4, 5 they engage. In the illustrated position, all wheels 4 are held by ridge 10' and all wheels 5 are held by ridge 9'. Upon shifting shaft 6 to the right, one or the other of wheels 4 is no longer held but is operatively coupled to ring 8, while a corresponding wheel 5 is coupled to ring 7. As far as the other wheels 5 is concerned, they are held by ridge 9', some of them may be held by ridge 10'. As far as other wheels 4 is concerned, some are still held by ridge 10' but others are not held against unwanted rotation by means of the shaft 3.

The shaft 6 has a hollow portion or extension 6a. The free end (opposite hand wheel 3) of that shaft and of its extension carries a locking or holding member 12. The axial length of that member exceeds the axial width of any individual display wheel 4; generally speaking, the axial length of member 12 must not be smaller than the axial width of the display wheels. However, the axial length of that member 12 is positively and significantly less than the axial width of all display wheels as positioned. A width equivalent to the sum of the width of two or three display wheels at the most well suffices.

Member 12 has also a projection 12' which may be a short round bar just as ridge elements 9' and 10', and being inserted in a recess of member 12 to be permanently connected thereto. This projection 12' will drop into a recess 20 of one or several of the display wheels 4 to lock it (or them) and prevent its (their) rotation. Thus, this projection or short bar 12' serves as key to hold one or a few of the display wheels. This keying action involves particularly any of the wheels 4 being located adjacent to a wheel 4 that is being turned by turning off shaft 6, and further being located on the side of ring 8 opposite sleeve 10.

Member 12 is seated on shaft portion 6a, the latter having an annular groove 16, and a pin in member 12 drops into that groove locking it axially but permitting relative rotation of these parts; particularly shaft 6, 6a can rotate relative to member 12, but the latter follows any axial displacement of the shaft.

Member 12 itself is impeded from turning by means of a lock bar 13, having non-round cross-section and being inserted in the interior of hollow shaft 6a. The bar 13 is affixed to casing 2 by means of a pin and slot arrangement permitting the bar to undergo limited movement in a direction of its flatness, but transversely to the axis of shaft 6a.

Member 12 is of hollow, cylindrical configuration with an end wall or a bottom 12a adjacent to the end of shaft 6a. That bottom 12a has a slot being traversed by bar 13 and mating the profile of the bar so that, indeed, member 12 cannot rotate relative to that bar. Thus, the non-round bar is keyed to locking member 12, holding it against rotational adjustment of the printer. However, member 12 can undergo axial displacement, following shaft 6 on account of the coupling structure 16, 17.

It can readily be seen that upon stepping axially the shaft 6 (knob 3), e.g. to the right, one pair of wheels 4, 5 after another is coupled to ring pair 7, 8 for purposes of rotational adjustment via knob 3. Other wheels are held by sleeves 9, 10 which holding function is supplemented by member 12, holding two wheels 4 to the left of adjusting ring 8. Further holding is not needed, i.e. wheels 4 which are farther to the left of adjusting ring 8, do not have to be held because they cannot be inadvertently coupled to a wheel 4 being turned.

Figure 3:
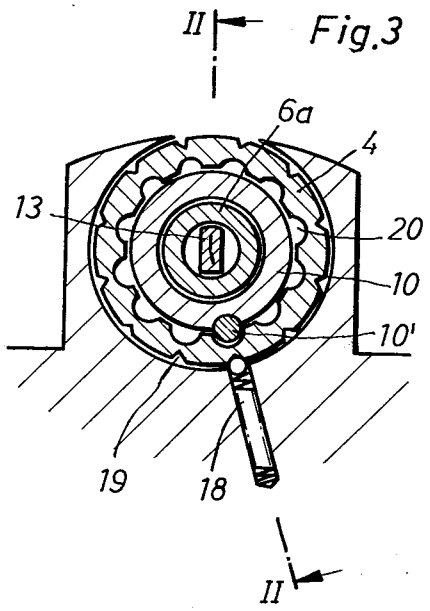
FIG. 3 is a cross-section taken along line III—III in FIG. 2.
Figure 2:
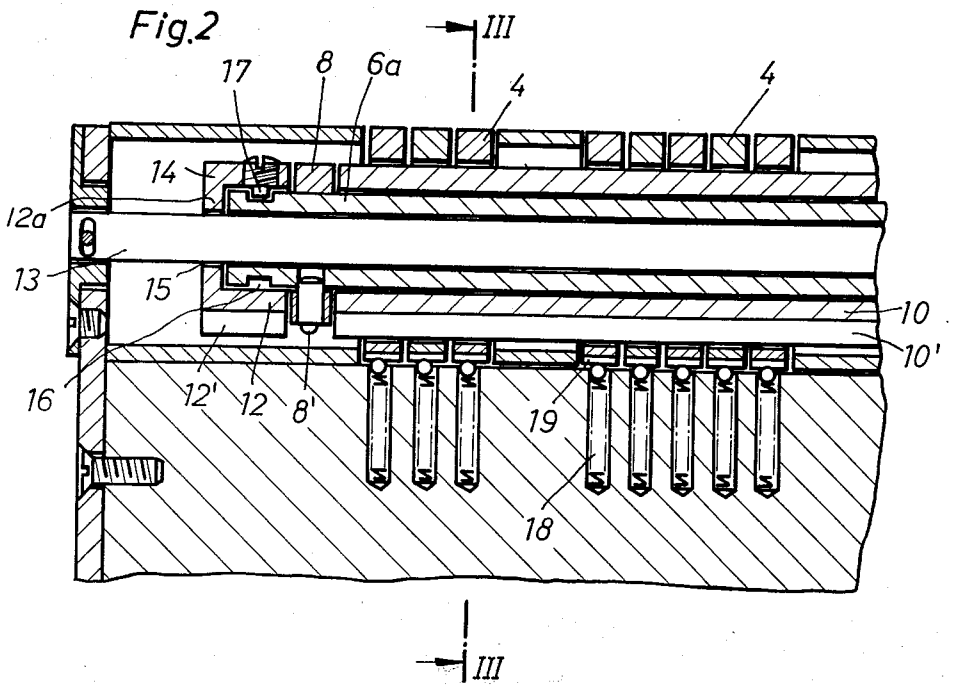
FIG. 2 is a longitudinal section of the display taken along line II—II in FIG. 3.

All wheels 4 are additionally held conventionally by means of balls which are spring biased by means of springs 18, to engage peripheral notches 19, one per wheel 4 as shown in FIG. 3. These additional locks hold specifically those of the wheels which are no longer held by member 12 or by sleeve 10. These ball locks are particularly provided to prevent external, accidental movement of the display wheels through means other than the adjusting shaft 3.

The invention is not limited to the embodiments described above but all changes and modifications thereof not constituting departures from the spirit and scope of the invention are intended to be included.

I claim:

1. In a digit printer, having axially displaceable shaft means capable of assuming different axial positions, there being external means for providing rotation of the shaft means;

a set of print wheels and a set of display wheels;

a pair of spaced adjusting means on the shaft means;

one of the adjusting means of the pair being located near one end of the shaft means, and being provided for individual engagement with the display wheels, the other one of the adjusting means being located farther away from said one end and provided for individual engagement with the display wheels, whereby for each one of different axial positions of the shaft means, the one adjusting means engages different display wheels and the other adjusting means engages correspondingly different print wheels, the engagement changing upon axial displacement of the shaft means, the respective wheels being engaged by the respective adjusting means, being rotated upon rotation of the shaft means;

a first sleeve on the shaft means being located between the two adjusting means and provided for axially moving together with the shaft means a second sleeve being located on the shaft means, on the other side of the other adjusting means, said second sleeve also provided for moving axially with the shaft means, the improvement comprising:

means for holding the first sleeve against rotation;

means on the first sleeve for holding any of the wheels located between the two adjusting means and preventing rotation of such wheels;

means for holding the second sleeve against rotation;

means on the second sleeve for holding any of the wheels upon being radially aligned therewith and preventing rotation of the wheels so held;

a locking member of the shaft means at said end and disposed next to the one adjusting means on the side opposite the first sleeve, the locking member connected for moving axially with the shaft means;

key means on the locking member having axial width for engaging and holding at least one of the display wheels upon radial alignment therewith, but said axial width being significantly less than needed to hold all display wheels;

said shaft means at said end being hollow;

a bar having a nonround cross section and traversing said locking member in keying relation and telescoping into the hollow interior of the shaft means;

means for holding the bar against rotation; and said bar permitting axial displacement of the shaft means and the locking member relative to the bar as held by the means for holding, thereby holding the locking member against rotation due to said keying relation, whereby said locking member holds those wheels it engages.

2. The improvement as in claim 1, said locking member being a sleeve with an end wall having a keying opening traversed by said bar.

3. The improvement as in claim 1 or 2, said key means being a bar inserted in the periphery of the locking member.

4. The improvement as in claim 1, said locking member being connected to the shaft means by means of a pin projecting into an annular groove of the shaft means.

* * * * *